United States Patent [19]

Burr et al.

[11] Patent Number: 4,479,440

[45] Date of Patent: Oct. 30, 1984

[54] RAIL CLIP DRIVING APPARATUS

[75] Inventors: Martin A. Burr, Sheffield; Brian G. Conroy; Maurice Spencer, both of Worksop, all of England

[73] Assignee: Pandrol Limited, London, England

[21] Appl. No.: 319,425

[22] Filed: Nov. 9, 1981

[30] Foreign Application Priority Data

| | | | |
|---|---|---|---|
| Nov. 10, 1980 | [GB] | United Kingdom | 8036074 |
| Mar. 6, 1981 | [GB] | United Kingdom | 8107049 |
| Jun. 9, 1981 | [GB] | United Kingdom | 8117644 |

[51] Int. Cl.[3] ..... E01B 29/24

[52] U.S. Cl. ..... 104/17 A; 104/1 R; 227/107

[58] Field of Search ..... 104/17 R, 17 A, 1 R, 104/7 R, 7 A, 8; 227/107, 147; 238/349

[56] References Cited

U.S. PATENT DOCUMENTS

| | | | |
|---|---|---|---|
| Re. 24,929 | 1/1961 | Saltz | 227/107 |
| 1,742,951 | 1/1930 | Erickson | 104/8 |
| 3,120,195 | 2/1964 | McWilliams | 104/17 R |
| 3,426,698 | 2/1969 | Foxx et al. | 104/17 R |
| 3,444,822 | 5/1969 | Oville et al. | 104/8 |
| 3,717,101 | 2/1973 | Katcha et al. | 104/17 R |
| 3,841,221 | 10/1974 | Dieringer et al. | 104/17 A |
| 3,942,000 | 3/1976 | Dieringer | 104/17 R |
| 4,073,435 | 2/1978 | Miller | 238/349 |
| 4,256,040 | 3/1981 | Dieringer | 104/17 R |
| 4,320,707 | 3/1982 | McIlrath | 104/17 A |

FOREIGN PATENT DOCUMENTS

| | | | |
|---|---|---|---|
| 1509900 | 5/1978 | United Kingdom . | |
| 1540868 | 2/1979 | United Kingdom . | |
| 2031486 | 4/1980 | United Kingdom . | |
| 2037348 | 7/1980 | United Kingdom | 104/7 B |
| 2060037 | 4/1981 | United Kingdom . | |

*Primary Examiner*—Randolph Reese

*Attorney, Agent, or Firm*—Norbert P. Holler; Charles A. Blank

[57] ABSTRACT

There is disclosed a trolley which runs along unfastened rails of a track, in which each rail is positioned between a respective one of two pairs of housings on each sleeper, the trolley moving from sleeper to sleeper in order to complete permanent fastening of the rails to the sleepers. The trolley has a pair of rail-clip driving apparatus on each side, one associated with each rail, of which each comprise a pair of magazines for storing e-shaped clips, and a clip driver for each magazine which drives a lowermost clip in a stack of clips in the magazine into a sleeper housing. Each apparatus includes a longitudinally displaceable support tube on which the magazines are mounted, the tube moving one way or the other depending upon which magazine first comes into cooperation with its respective housing in order to bring the other magazine into cooperation with its housing. The apparatus may move laterally relative to the trolley via a pair of parallelogram linkages provided one at each end of the support tube in order to adjust the apparatus to a changing path of the rails. A sleeper lifter may be provided to raise sleepers which are too low, and a sleeper sensor responds to the presence of a metallic housing on a sleeper in order to stop the trolley as it advances from sleeper to sleeper.

22 Claims, 15 Drawing Figures

RAIL CLIP DRIVING APPARATUS

This invention relates to rail-clip driving apparatus which is intended to be mounted on a mobile device, such as a self-propelled trolley, which runs along unfastened rails of a track and drives fastening clips into clip housings provided on track sleepers in order to hold down the rails onto the sleepers.

When a track is being laid, each rail is usually positioned initially between the clip housings of one of two pairs of housings on each sleeper, and then fastening clips are partly inserted into the housings by hand, before the trolley is advanced to the sleeper to carry out clip-driving operations. The necessity to insert the clips by hand is a laborious and time-consuming procedure and it is therefore a primary objective of the invention to provide clip-driving apparatus for a trolley which can store fastening clips in a convenient manner and can carry out automatic dispensing and driving of the clips into the housings as the trolley moves from sleeper to sleeper.

It is a further object to provide apparatus which can automatically adjust itself so as to dispense and drive fastening clips into the housings on each side of the rail even when there is some inaccuracy in the positioning of the sleepers.

It is another object to provide apparatus which can automatically adjust its position laterally of the trolley to suit changes in the track.

A still further object is to enable the trolley to be stopped automatically as it advances from sleeper to sleeper, by provision of a sleeper sensor device.

Embodiments of apparatus according to the invention will now be described in more detail, by way of example only, with reference to the accompanying drawings in which.

Figure 1:
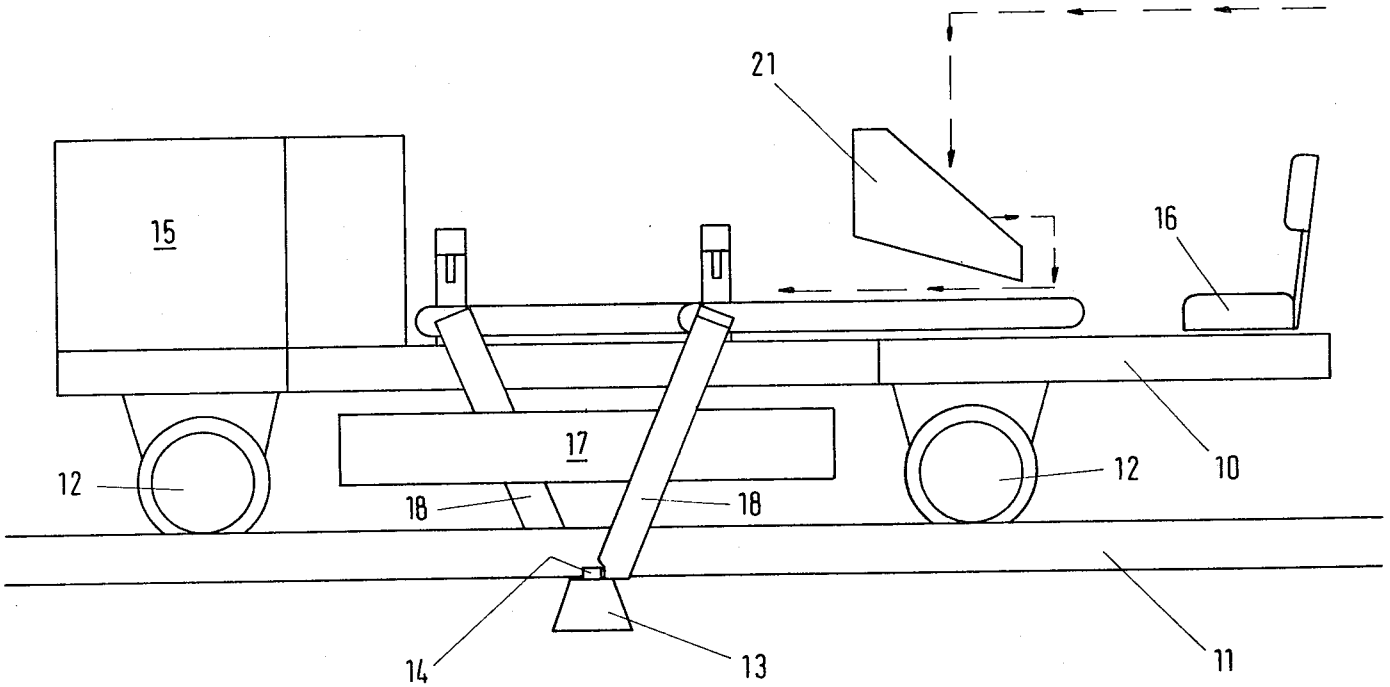
FIG. 1 is a schematic side view of a trolley on which apparatus according to the invention is provided.
Figure 2:
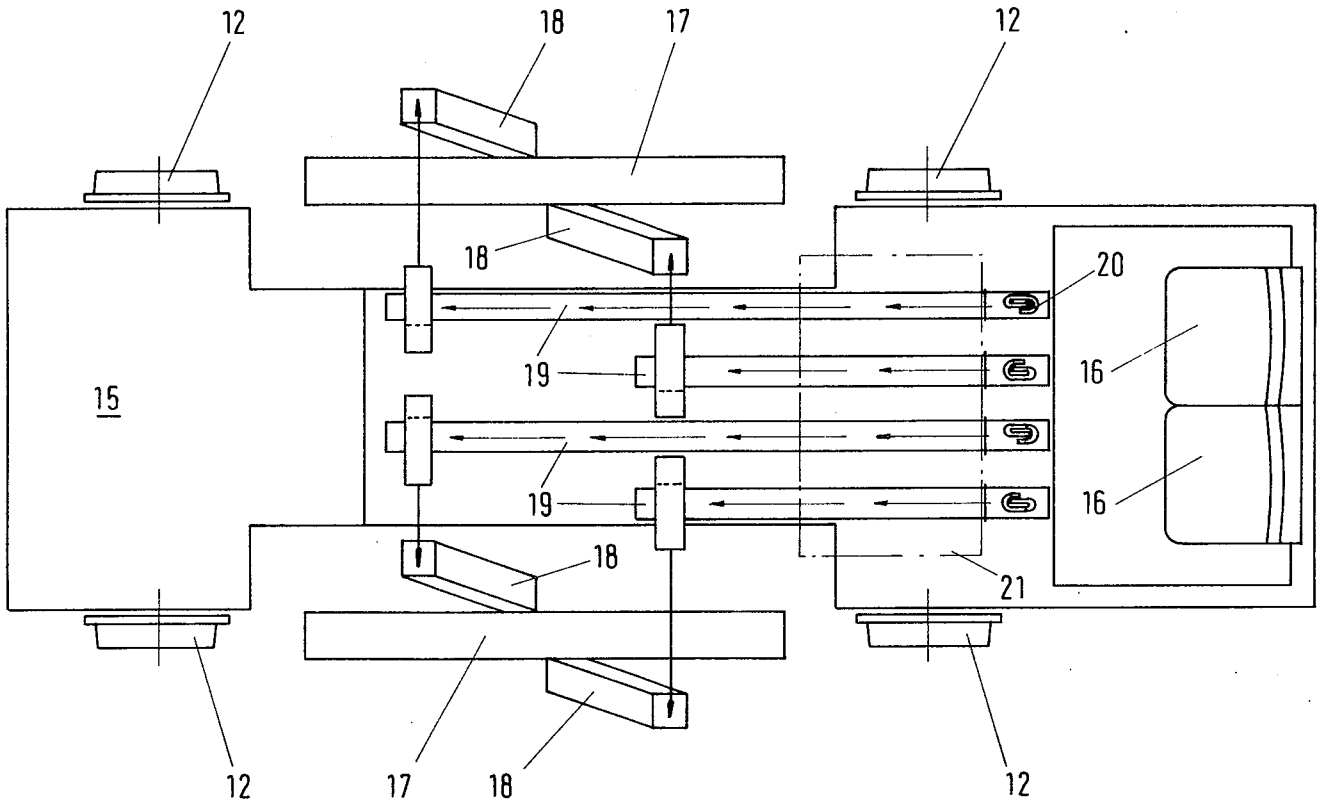
FIG. 2 is a plan view of the trolley shown in FIG. 1.

Referring now to the drawings, there is shown schematically in FIGS. 1 and 2 a trolley which runs along unfastened rails of a track and operates automatically to make permanent fastening of the rails to the track. Each rail is laid on a series of sleepers and is located between a usual pair of housings on each side of the sleeper which subsequently receive rail fastening clips in order to hold down the rail permanently onto the sleeper. The trolley carries apparatus on each side i.e. one associated with each rail, which each operates automatically to drive rail fastening clips into the sleeper housings in order to fasten the rail to the sleepers.

The trolley shown in FIGS. 1 and 2 comprises a main frame or chassis 10 which is supported on rails 11 by four wheels 12. The rails 11 are laid initially on a series of sleepers, one of which is shown at 13, between a pair of clip-receiving housings 14 provided on each sleeper i.e. each sleeper has four housings 14, arranged in pairs, with a spacing between the housings in each pair sufficient to allow a rail to be laid therebetween. The trolley has a power unit 15 at one end and a pair of operator seats 16 at an opposite end.

Adjacent each side of the trolley there is mounted on the chassis 10 apparatus 17 for driving rail clips into the sleeper housings 14. The apparatus 17 is shown only schematically in FIGS. 1 and 2, and incorporates a sleeper finder device, a sleeper lift device, magazines for storing a supply of fastening clips, a longitudinally yieldable mounting for a purpose which will be described in more detail later, a rail-follower device, and a further mounting permitting lateral movement of the apparatus relative to the chassis 10.

Each apparatus 17 has a pair of magazines 18 attached thereto, each magazine serving to dispense clips to the sleeper housing 14 on a corresponding side of the rail. If desired, an automatic conveyor device 19 (fed by a hopper 21) may be provided on the chassis 10 in order to feed replacement clips 20 automatically to the stack of clips contained in each magazine 18.

Figure 3:
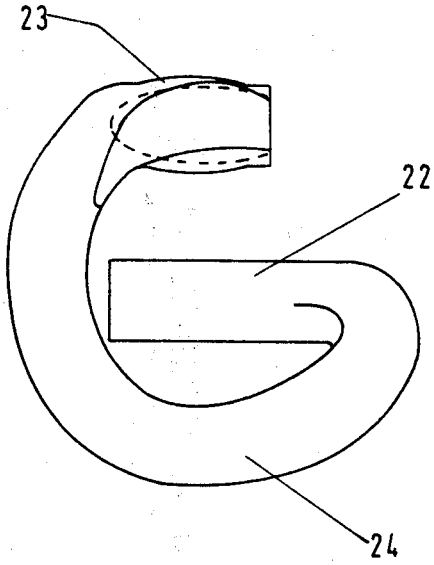
FIG. 3 is a plan view of one type of rail clip which can be driven into rail sleeper housings in order to hold down a rail, by means of apparatus according to the invention.

Referring now to FIG. 3, there is illustrated in more detail one type of rail fastening clip, known as an e-clip (which is described in more detail in British Patent Specification No. 1,510,224) which can be driven into the housings 14 by the apparatus 17. However, the apparatus may be used to drive other types of rail clips, such as so-called "P-R clips", (disclosed in British Patent Specification Nos. 861,473 and 869,385), or so-called flat-toe P-R clips (disclosed in British Patent Specification No. 1,213,762). The drawings of the present specification refer only to the e-clips.

The e-clip shown in FIG. 3 is made by bending a metal bar substantially into the form of an e, and comprises a centre leg 22 which is received by the housing 14, an end portion 23 which engages downwardly onto the lower flange of a rail and a curved portion 24 which engages downwardly on a shoulder of the housing 14. The clips are stored in a stack within each magazine 18, which forms a slideway within which the clips can fall under gravity to a lower discharge end of the magazine, and are driven into the housings 14 by means of a clip driver 25 (see FIGS. 4 and 5). The clip driver 25 has a curved face 26 which engages a rear arch 27 of the clip and a face 28 which engages the end portion 23 of the clip. The face 28 is provided on the end of a finger 29 of the clip driver 25.

Figure 4:
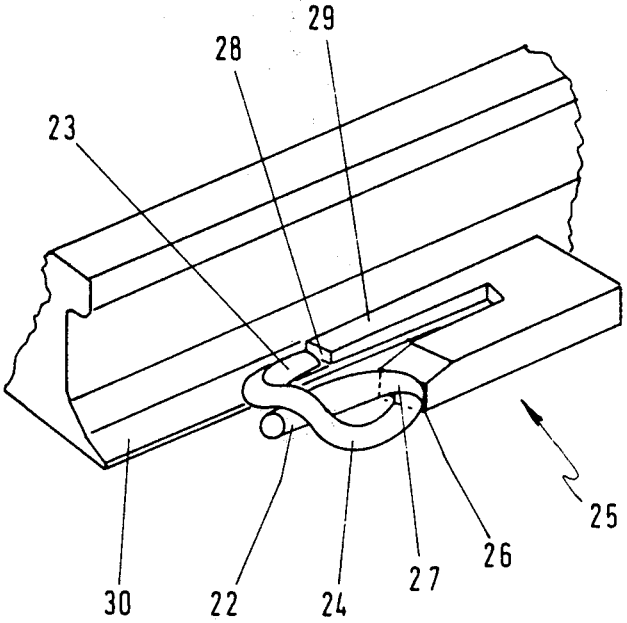
FIG. 4 is a detail illustration of a rail clip driver.
Figure 5:
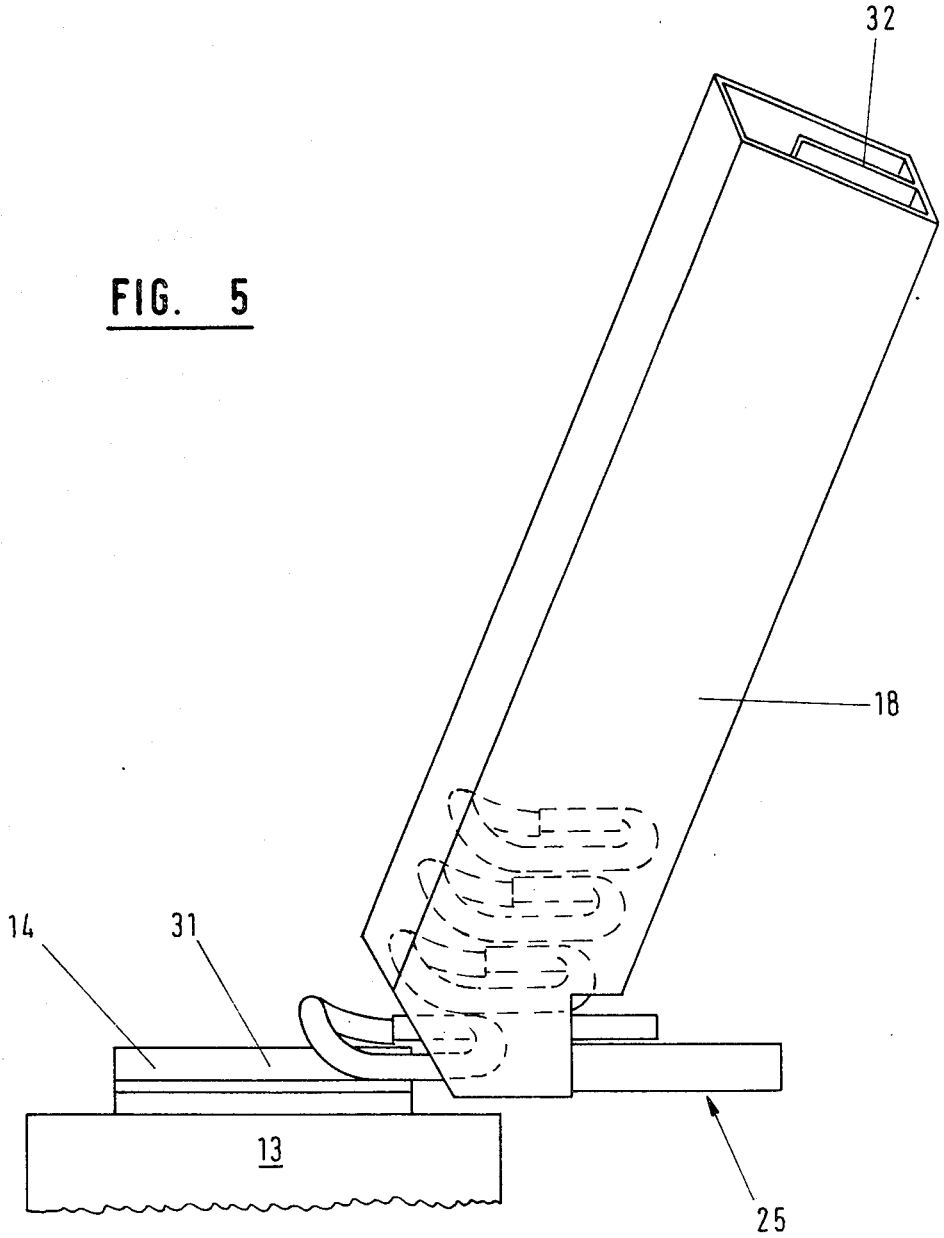
FIG. 5 is a detail side illustration of a magazine for storing a stack of rail clips which are dispensed consecutively from the bottom of the magazine by the clip driver shown in FIG. 4.

As will be seen from FIGS. 4 and 5, the clip driver 25 can drive the clip so that the centre leg 22 enters within the housing 14, the end portion 23 engages downwardly onto lower flange 30 (see FIG. 4) of a rail, and curved portion 24 engages downwardly on shoulder 31 of the housing 14.

The apparatus 17 will be described in more detail later. However, referring back to FIG. 2 of the drawings, it will be apparent that each apparatus 17 has a pair of magazines 18 associated therewith, and related mechanism for driving clips into the housings provided one on each side of the associated rail. The arrangement is such that the centre legs 22 of the e-clips in the two associated magazines are driven in opposite directions into the housings on opposite sides of the associated rail. A similar arrangement is provided in respect of each rail, and the arrangement is such that four clips used on each sleeper can be driven into position substantially simultaneously.

Figure 6:
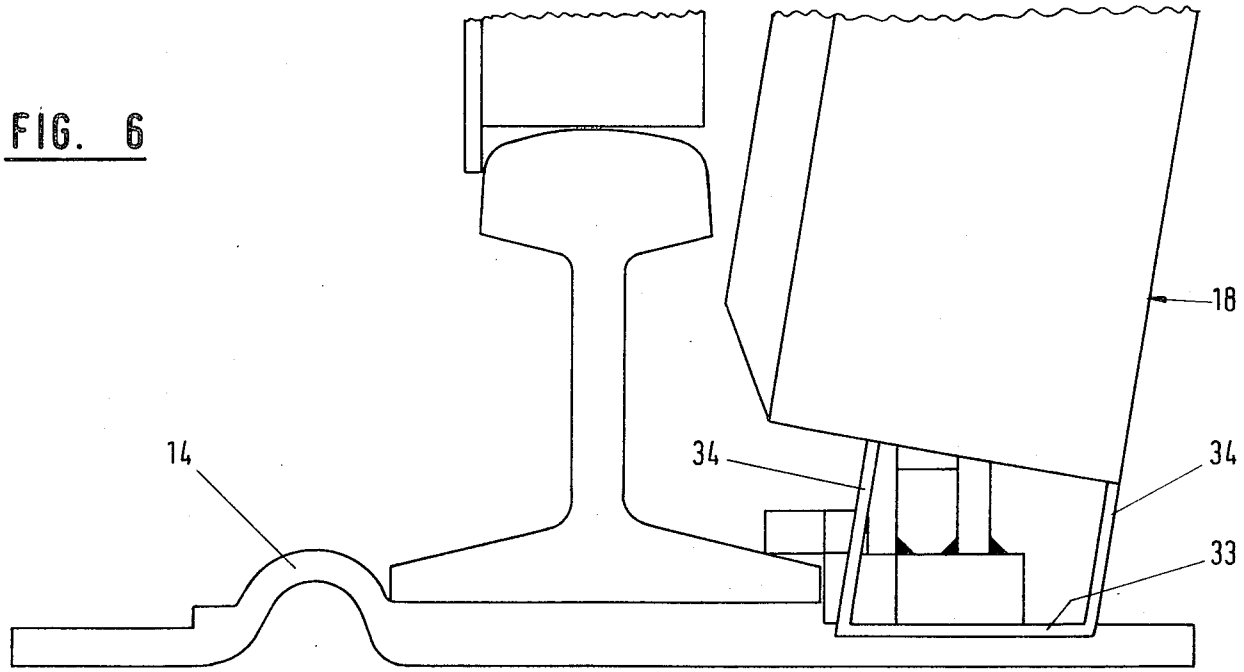
FIG. 6 is an end view of the magazine shown in FIG. 5, positioned on one side of a railway rail adjacent to a rail clip housing.

The construction of each magazine is shown in more detail in FIGS. 5 and 6, and each magazine comprises a straight tubular chute, inclined to the vertical, made of sheet steel and of rectangular internal and external shape. The chute could have rounded internal corners. Within each chute there is arranged a stack of e-clips with their centre legs horizontal. A sheet steel web 32 projects into the chute from one side (the web being inclined to the normal to that side) and projects between the two end portions of the bar from which each clip was made i.e. between centre leg 22 and end portion 23. Guided by this web 32 and the walls of the chute, each clip can slide down the chute without its orientation being able to change substantially, the centre leg of each clip remaining horizontal or nearly horizontal. At the bottom of each chute, there is a horizontal stop plate 33 which is connected to the chute by two side plates 34, thus forming a housing which is open at the left side and the right side, considering FIG. 5.

The clip driver 25 can be reciprocated through the open housing at the bottom of the chute in order to drive the clip from a location within the housing, resting on the stop plate 33 and at the bottom of the stack of clips in the chute, so that the centre leg 22 enters the housing 14. During this driving by the clip driver 25, the latter supports the lowermost clip, of the stack of clips within the magazine, and prevents it from coming out of the chute. After the clip has been driven, the clip driver is retracted at the same time as the magazine, allowing a clip to drop readily for insertion when the magazines are lowered on arrival of the trolley at the next sleeper. The surface 26 of the clip driver 25 just remains in, or just comes out of, the housing at the bottom of the magazine, but finger 29 remains in the housing, supported by the stop plate 33. The clip driver is then moved to the left, driving a further clip into a housing 14, and then the process is repeated for the next sleeper.

The face 26 of the clip driver 25 is concavely curved to match the curves of the rear arch 27 of the clip.

As will be seen in FIG. 4, the finger 29 of the clip driver 25 slides along the top of the rail flange 30, in contact with it, and any convenient means may be provided on the finger 29, to engage slidingly with the side face of the rail flange 30 in order to guide accurately the movement of the clip driver 25.

While there has been illustrated individual magazines 18 provided one on each side of the apparatus 17, the magazines may be arranged in the form of a group of chutes, each with a web as described above. Although not shown, the group may comprise nine chutes arranged in three rows each comprising three chutes. Each is of rectangular cross-section, made of steel plate and with a web 32 of steel plate welded along one edge to one side of the chute and projecting from that side of the chute into the interior of the chute. The chutes may be secured together and may be vertical or inclined, for example by less than 45°, to the vertical. The corners of the chutes may be rounded, or provided by surfaces at 45° to two adjacent sides of the chute, or they may be square. Each web projects between the end portions of each bar from which a clip in the relevant chute was made. When a clip is removed from the bottom of the chute, the clips above it descend. They are guided by the web 32 and one or more sides of the chute, and are thereby prevented from undergoing any substantial change in orientation. If the chute is vertical and the clips are as shown in FIGS. 1 to 3 or FIGS. 4 to 6 of British Patent specification No. 1,510,224, each clip remains substantially in the orientation shown in FIG. 2 or FIG. 5 of that specification.

The group of chutes form a magazine on a trolley which travels along a railway track. The magazine may store clips which have been removed from rail fastening positions on the track and/or new clips. Clips may be fed into the top of one chute unit it is full, then into the top of another, until that is full, and so on, either by hand or automatically. Clips may be drawn from the bottoms of the different chutes in sequence and fed along a bar or bars, upon which the clips are suspended, to apparatus on the trolley for driving them into rail fastening positions. Instead of a single trolley carrying all the parts described above, or a magazine composed of a group of chutes, there may be two or more trolleys coupled together and carrying these parts.

Figure 7:
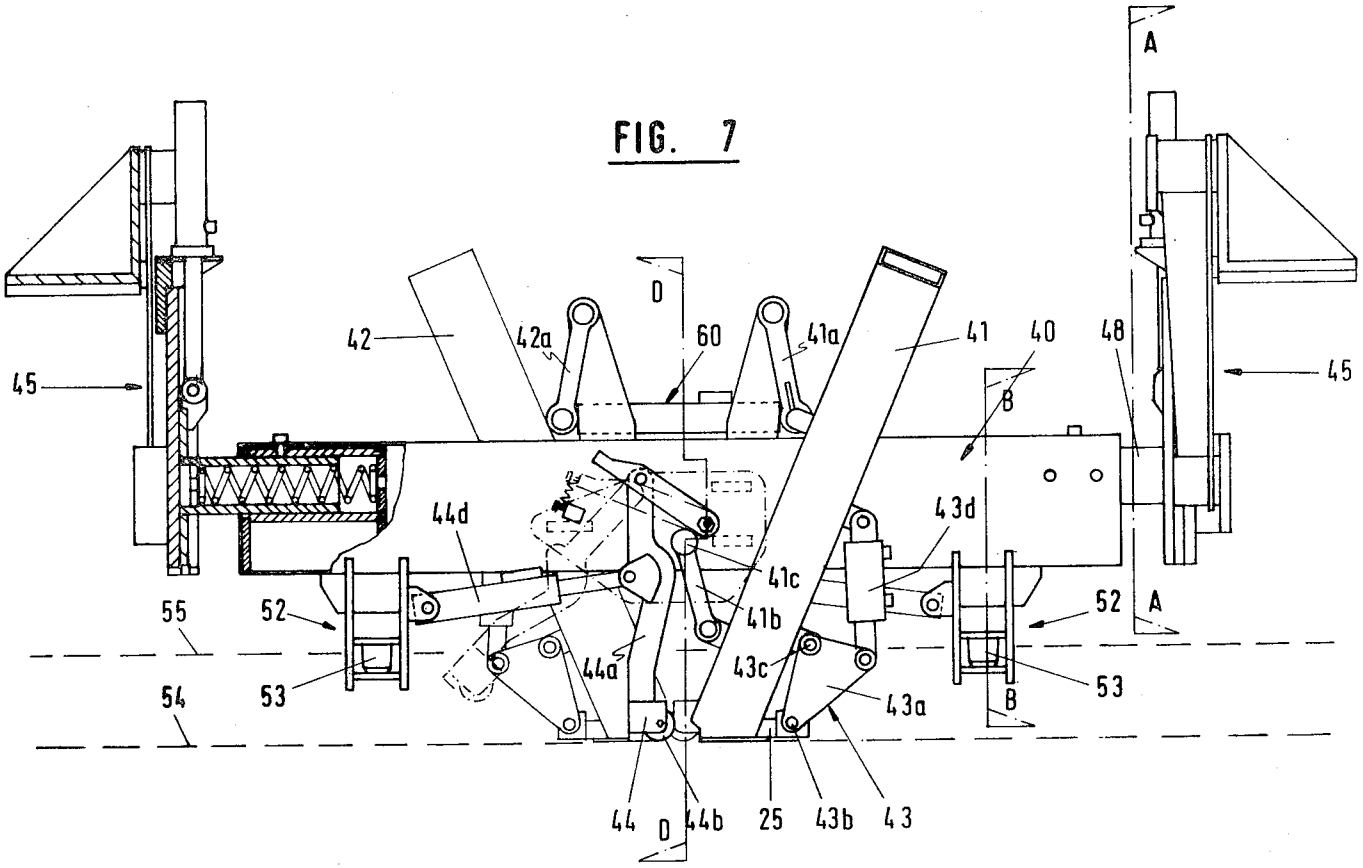
FIG. 7 is a side view of apparatus according to the invention applied to one side of the trolley shown in FIGS. 1 and 2.

Referring now to FIG. 7, there is shown in more detail the construction of apparatus 17 which will be mounted on one side of a trolley or other mobile device for moving along unfastened rails of a track, and preferably the trolley will be provided with a pair of such apparatus, one arranged at each side in order to complete a rail-fastening operation on a respective rail. Each apparatus comprises a support member 40 which supports first and second slideways or magazines 41 and 42, each constructed to receive a stack of e-shaped fastening clips, with their centre legs substantially horizontal, and each slideway including a guiding part which projects between the two end portions of each clip in its stack of clips. Means is provided for moving the lower end of the first slideway 41 towards a first housing 14 on one side of a rail and for moving the lower end of the second slideway 42 towards an adjacent second housing on the opposite side of the rail, the arrangement of the apparatus being such that if, due to misalignment of a sleeper, the first slideway would be able to cooperate with the first housing before the second slideway would be able to cooperate with the second housing, the support member moves along the rail until the first and second magazines are able jointly to cooperate with the first and second housings. The apparatus also includes means for driving the lowest clip in each stack from a particular location at the bottom of the related slideway, so that its centre leg enters one of the housings.

The apparatus includes a clip driving device, designated generally by reference 43, which operates the clip driver 25. The device 43 comprises a triangular lever 43*a* which is connected by a pivot pin 43*b* to one end of the clip driver 25, the lever 43*a* being pivotable about a pivot 43*c* by means of a piston and cylinder device 43*d*. Operation of the device 43*d* effects linear reciprocation of the clip driver 25.

When the clip driver 25 moves to the left out of its position at the bottom of the magazine or slideway 41, it stops the next clip from descending to occupy the same position until after the clip driver 25 has been moved to the right.

The magazines 41 and 42 are inclined in opposite senses to the vertical, and serve to supply clips which are driven into housings on opposite sides of the rail. The magazine 42 has a clip driver 25 which operates in the same way, though in reverse direction, to the clip driver of magazine 41.

The apparatus also includes a sleeper follower and lifter device 44 which operates to lift a sleeper which is too low, and which is movable between an inoperative position shown in dashed outline and an operative position, shown in full outline. An arm 44*a* is pivotally connected at its upper end on support member 40 and carries a wheel 44*b* and a pin 44*c* (see FIG. 12) which is to be inserted in the passageway through one of the housings. When a sleeper locator (to be described later) indicates that the apparatus is in an appropriate position with respect to a sleeper, the arm 44*a* is swung anticlockwise by a piston and cylinder device 44*d*, the wheel 44*b* runs on top of the sleeper, the pin 44*c* enters the passageway through the housing, and eventually, when the sleeper is at the right height, the arm 44*a* becomes almost vertical (FIG. 7). Subsequent driving of a clip by the clip driver 25 into the passageway of the housing from the opposite end displaces the pin 44*c* from it, and the arm 44*a* is then retracted.

There is a sleeper lift device 44 on each side of each rail, carried by the support 40, and in the event of misalignment of a sleeper so that one magazine would tend to come into cooperation with its sleeper housing before the other magazine comes into cooperation with its housing, the support 40 moves longitudinally of the rail until such time as both magazines can move into full cooperation with their housings so that clip driving can then take place. Thus, the sleeper lift devices serve to centralise longitudinal floating of the apparatus, following engagement with the respective sleeper housings, so that satisfactory clip driving operations can be carried out. The magazines are only swung down for clip driving operations after the sleeper has been engaged (and raised if necessary) by the sleeper lift devices 44.

Preferably, though not shown, the bottom rail flange rests on a pad and an electrical insulator of substantially L-shaped cross-section is arranged to insulate the housing and the curved portion 24 of the clip from the rail flange when the clip is driven home.

The magazines 41 and 42 are pivotally connected to the support 40 by upper links 41*a* and 42*a* to a piston and cylinder arrangement 60 arranged on the upper surface of support 40. The magazine 41 is also connected by lower link 41*b* to the support 40, the link 41*b* being pivotally mounted on a transverse shaft 41*c* which is taken through the support 40. A similar lower link (not shown) connects the magazine 41 to the support 40. Operation of the piston and cylinder arrangement 60 causes the magazines 41 and 42 to be raised after a clip driving operation has been completed on one sleeper (see FIG. 10 which shows the magazines in the raised position), and then lowered when the trolley has been advanced to the next sleeper. It should be noted that the clip drivers 25 and related parts will also move with the magazines.

The support 40 is hollow and is mounted on the side of the trolley so as to be capable of yielding resiliently along its axis in the event that either one of the magazines 41 or 42 would tend to come into cooperation with its respective housing before the other one due to slight misalignments of the sleepers. When this occurs, the support 40 is able to yield until such time as the other magazine comes to co-operation with its housing, when the clip driving operations can be carried out.

Figure 8:
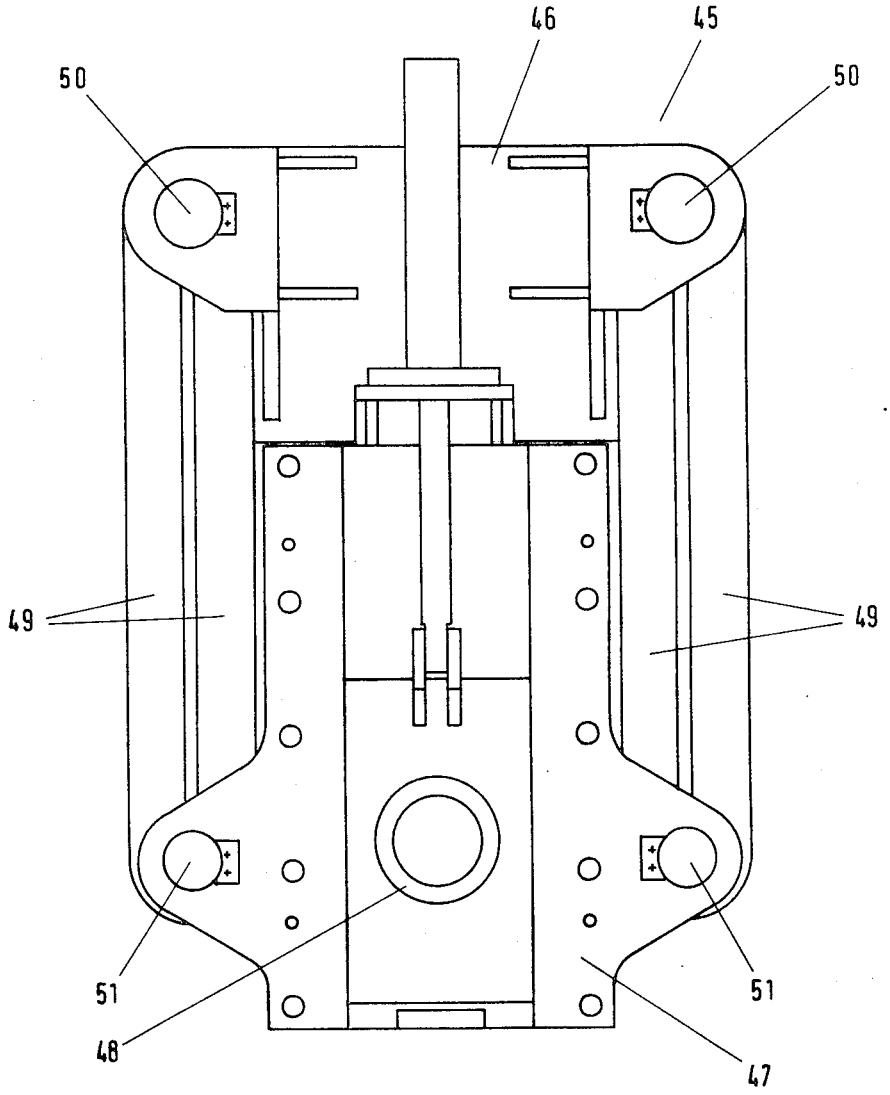
FIG. 8 is a sectional view taken on the line A—A in FIG. 7.

The hollow support 40 is mounted for longitudinal movement, against resilient opposition in either direction, on stub shafts 48 which are each carried by a respective mounting arrangement which is connected to the apparatus and is mounted on the trolley in such a way as to enable the entire apparatus and related parts to carry out lateral movement relative to the trolley i.e. independent of the movement of the trolley. The mounting arrangement comprises a pair of parallelogram linkages arranged fore and aft of the apparatus, one at each end of the support member 40. One of the parallelogram linkages is shown in more detail in FIG. 8, and is designated generally by reference numeral 45. The parallelogram linkages 45 serve to suspend the apparatus, at each side of the trolley, from the main chassis of the trolley. By the inherent nature of a parallelogram linkage, each apparatus carries out substantially horizontal and lateral movement, without any appreciable vertical displacement, bearing in mind that only relatively small lateral movements will normally be required. The upper end 46 of each linkage 45 is mounted at any convenient suspension point on the trolley, and the longitudinal support member 40 is mounted in the lower end 47 of the linkage 45 via projecting stub shaft 48 (see FIGS. 7 and 8). The lower end 47 of the linkage 45 is hung from the upper end 46 by means of upright links 49 which are mounted on pivots 50 in the upper end 46 and pivots 51 in the lower end 47.

Figure 9:
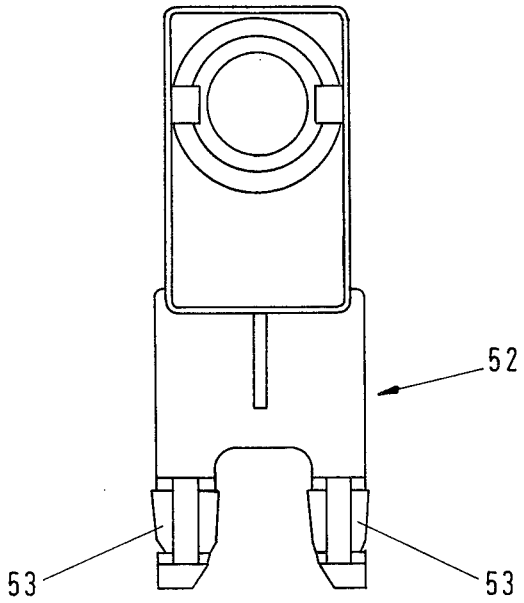
FIG. 9 is a sectional view taken on the line B—B in FIG. 7.

Insofar as the entire operating parts of the apparatus are mounted directly, or indirectly on the support member, the entire apparatus is capable of carrying out lateral movement with the support member 40 in order to follow lateral displacement of a rail. In order to provide for automatic guidance of the apparatus laterally with respect to its related rail, a rail follower device is provided which engages the upper end of the rail. As shown in FIGS. 7 and 9, the rail follower device comprises a pair of guiding devices 52 arranged fore and aft with respect to the operating parts of the apparatus, each guiding device comprising a pair of rollers 53 which are rotatable about vertical axes and are spaced apart by a sufficient distance to accommodate therebetween the upper end of a rail. The guiding devices 52, which engage the upper end of a rail, are particularly suitable for laterally guiding the trolley when it is moving along new rails, or rails having unworn top flanges. Evidently, during travel of the trolley, the guiding devices 52 will follow lateral displacements of the rail, which will then be accompanied by corresponding lateral displacement of the support member 40 and the related parts of the apparatus. In FIG. 7, the base line of a sleeper is shown by reference line 54, and the upper surface of a rail by line 55.

Figure 10:
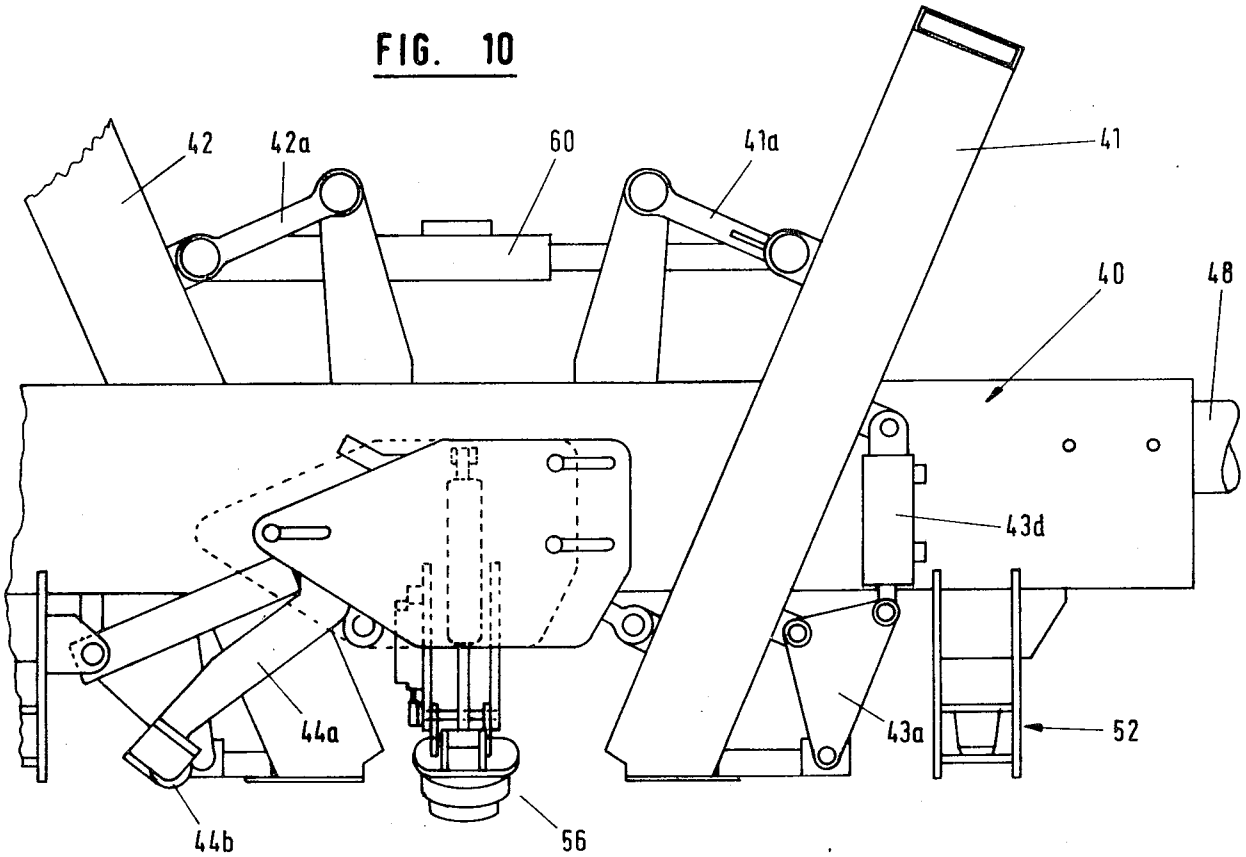
FIG. 10 is a view, similar to FIG. 7, illustrating a sleeper sensing device mounted on the apparatus.
Figure 11:
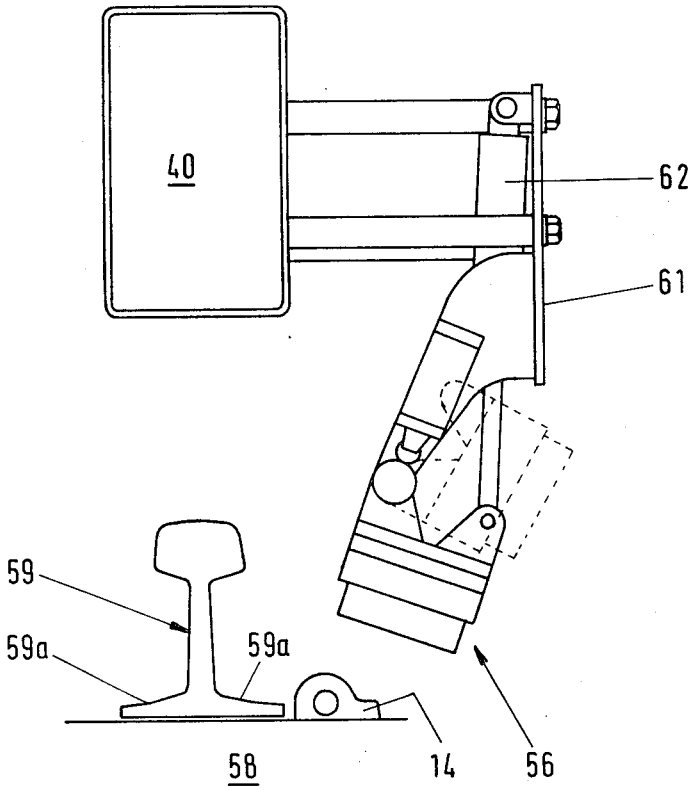
FIG. 11 is a detail view of the sensing device, looking in the direction of a rail.

In order to provide automatic control over the motion of the apparatus between successive sleepers, a sleeper sensing device may be provided on the apparatus, as shown in more detail in FIGS. 10 and 11. The sleeper sensing device comprises a sensor 56 which is arranged to respond to the presence of metal on each sleeper i.e. to housing 14 which is usually made of metal and which is anchored in the sleeper. The trolley on which the apparatus is mounted is preferably self-propelled, and has a control arrangement which automatically advances the trolley from one sleeper to the next when a rail-fastening operation has been completed, and the sensing device is arranged to cause automatic stoppage of the trolley whenever it reaches the next sleeper, as detected by the sensor 56 when it responds to the presence of a metallic housing in the sleeper.

The sensor 56 is shown occupying a sensing mode in which it moves closely over the surface of a sleeper, and reference should be had particularly to FIG. 11 which shows the sensor 56 positioned above metallic housing 14 for a rail-fastening clip, the housing 14 being anchored in a sleeper 58 on which a rail 59 has been laid. Although only one housing is shown in FIG. 11, usually a pair of housings will be arranged on the sleeper 58 at a sufficient spacing apart to allow the rail 59 to be laid therebetween, prior to completion of the hold-down operation by insertion of fastening clips into the housings, which bear down on the lower flanges 59*a* of the rail 59 in order to hold-down the rail.

Figure 12:
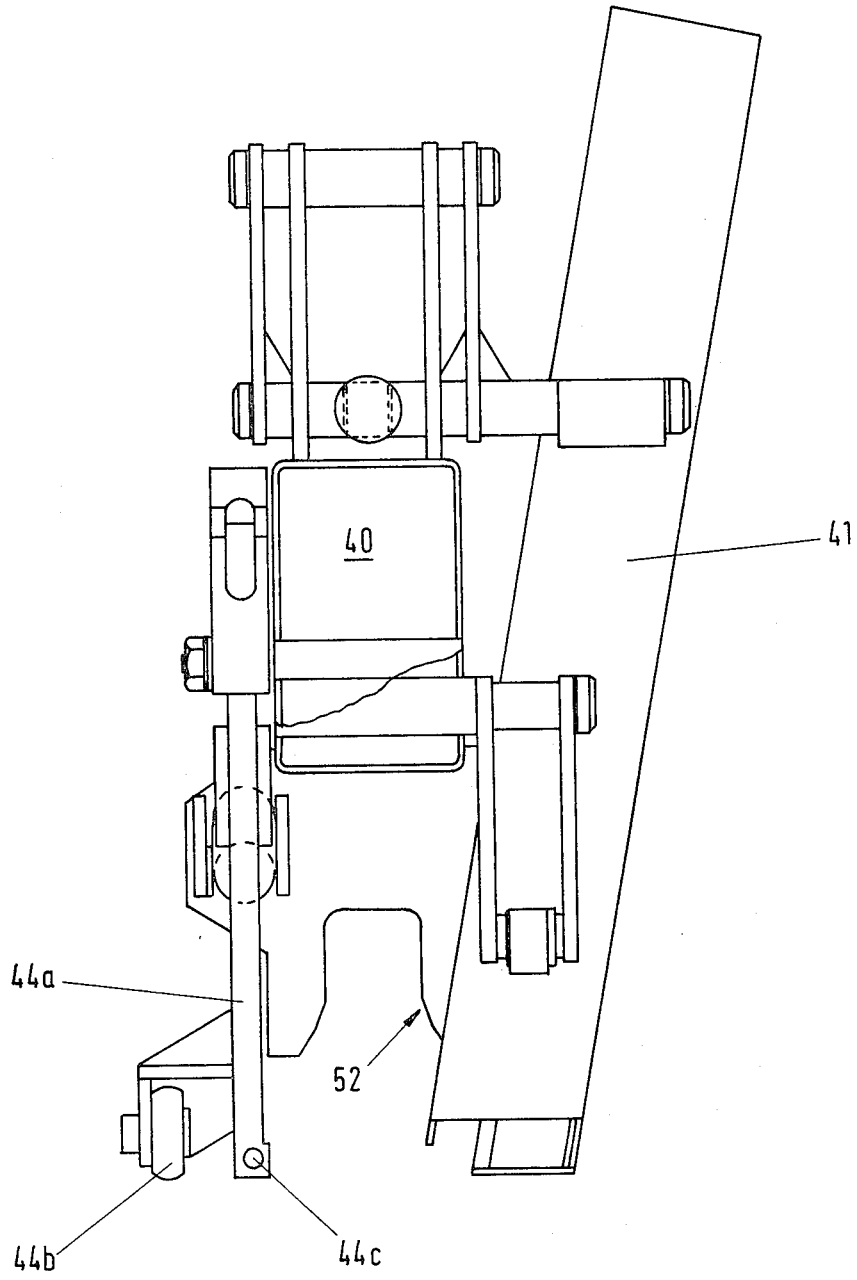
FIG. 12 is a part sectional view, taken on the line D—D in FIG. 7.

The sensor 56 is pivotally suspended by a framework 61 which is attached to the support member 40, and is able to pivot, under the control of a hydraulic ram 62 from the sensing position as shown in FIGS. 11 and 12, to an inoperative mode or position, shown in broken lines in FIG. 11, in which it is out of the way of, and does not impede the operation of the various devices for carrying out the rail-fastening operations.

The control over the operation of the sensing device will be such that it automatically pivots to its inoperative mode whenever it has detected the presence of a housing and prior to operation of the various parts of the apparatus. When the rail hold-down operation has been completed, the trolley is automatically controlled to move to the next sleeper, and the sensor 56 will pivot back to its sensing move so that it can detect the presence of the next sleeper, as it responds to the presence of the metallic housing thereon.

Figure 13:
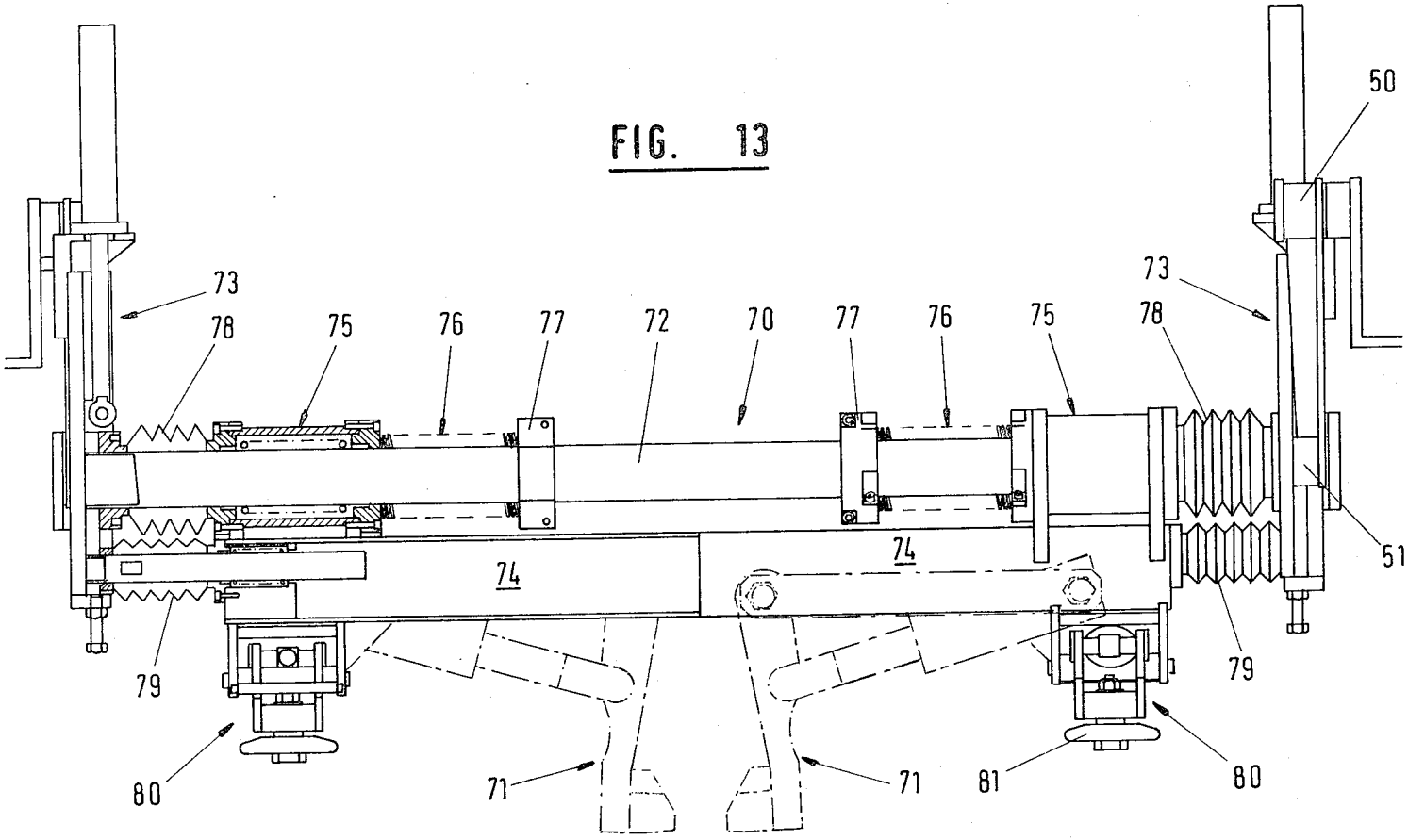
FIG. 13 is a side view illustrating an alternative means of longitudinally yieldably mounting the apparatus on the trolley.
Figure 14:
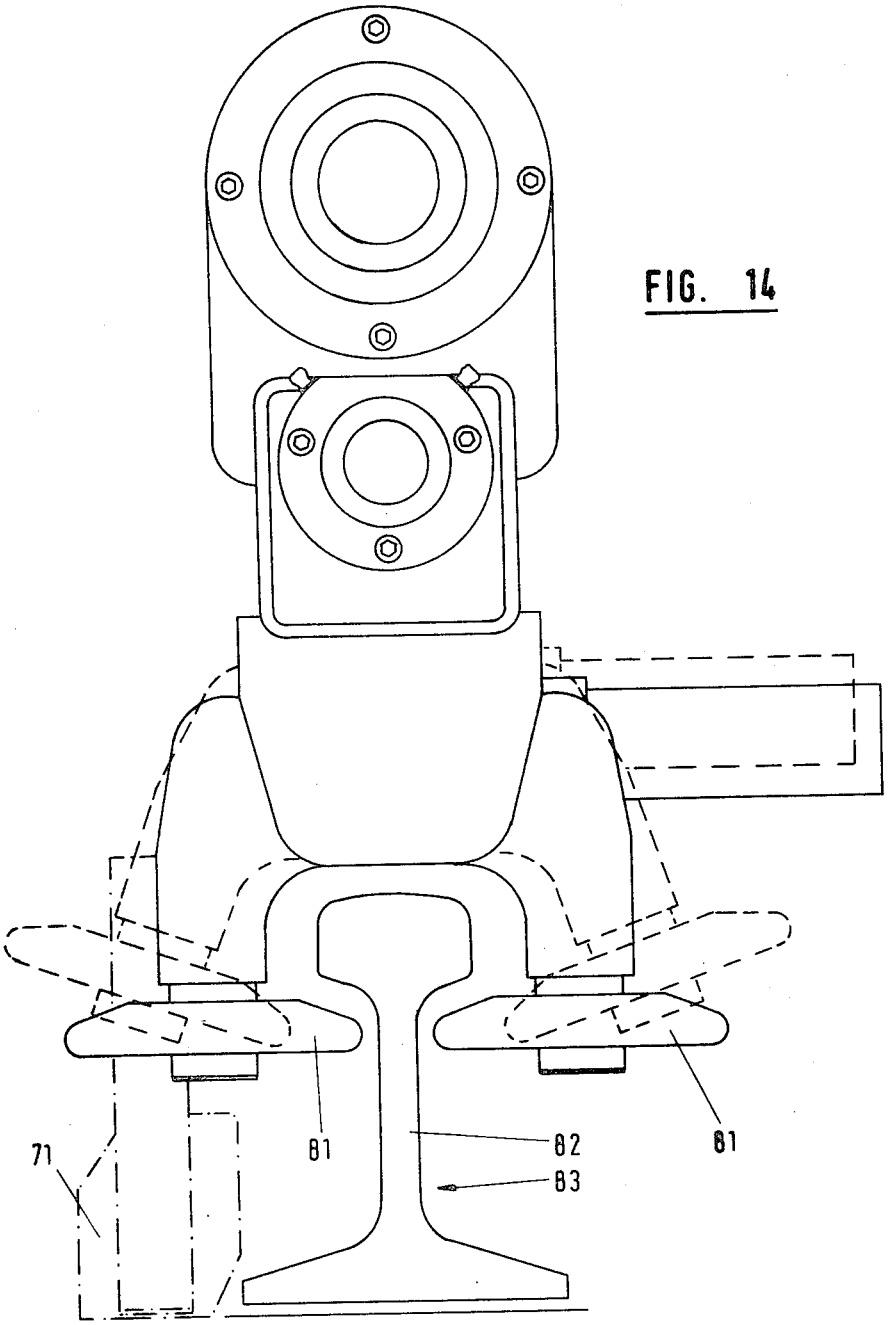
FIG. 14 is an end view of the apparatus, positioned over the rail, and illustrating an alternative construction of rail-follower device.

Referring now to FIGS. 13 and 14, there is shown an alternative construction of longitudinally displaceable hollow support member, equivalent to support member 40 described above with reference to the previous Figures. There is also shown an alternative construction of rail-follower device. The parallelogram linkage by which the support member is mounted on the trolley, to enable lateral movement of the apparatus, is the same as in the previous Figures, and will not be described in detail again.

No clip magazines are shown in FIGS. 13 and 14, nor a cooperative clip driving mechanism. Furthermore, the sleeper finder and the sleeper lifter are not shown. These components may be mounted on the longitudinally displaceable support member of FIGS. 13 and 14, designated generally by reference numeral 70, if desired. However, the support member 70 may be provided on a trolley which is intended to be used to drive home rail fastening clips which have been previously positioned in the respective sleeper housings by hand. Clip driving mechanisms known per se, designated by reference 71 and shown in dashed outline in FIG. 13, may be provided if desired.

Referring to FIG. 13, the longitudinal support member 70 comprises a top tube 72 which is pivotally mounted at each end in the lower end of a parallelogram linkage 73, which is generally similar to that already described above with reference to FIGS. 7 and 8. The tube 72, however, extends rigidly between the linkages 73 i.e. it is not telescopic as is the support member 40 in the previous embodiment. Below the tube 72, there is mounted a longitudinally resiliently displaceable member 74. The member 74 is suspended below the tube 72 and is connected thereto by a pair of slidable bearing boxes 75 which are mounted on tube 72. Each bearing box 75 is connected at its inner end by a spring 76 to a fixed abutment 77 on the tube 72, and is connected at its other end by a bellows 78 to the respective linkage 73.

The purpose of the springs 76 is to maintain the member 74 in an equlibrium position, but to provide resilient opposition to longitudinal displacement of the member 74 in either direction. The bellows 78 provide protection against ingress of dirt etc to the bearing boxes 75. The member 74 is connected at each end to the adjacent linkage 73 by bellows 79.

In FIGS. 13 and 14, there is also illustrated an alternative construction of rail follower device, designated generally by reference numeral 80. The rail follower devices 80 are mounted fore and aft of the apparatus, in similar manner to the rail follower devices 52. The essential difference in the device 80, over the device 52, is that guidance is achieved by engagement with the web of the rail, rather than the top flange. To this end, each device 80 comprises a pair of spaced rotary wheels 81 which are rotatable about vertical axes and define therebetween, as shown in FIG. 14, a sufficient gap to accommodate the web 82 of a rail 83. The wheels 81 are pivotable outwardly about respective horizontal axes, by an convenient means (not shown in detail), such as a piston and cylinder arrangement, to an inoperative position as shown in dashed outline in FIG. 14.

The guiding devices 80 shown in FIGS. 13 and 14 are particularly suitable for guiding the trolley along old track, since they provide guidance by engagement with the flange 82, which is not subject to wear, as is the top flange of a rail.

Figure 15:
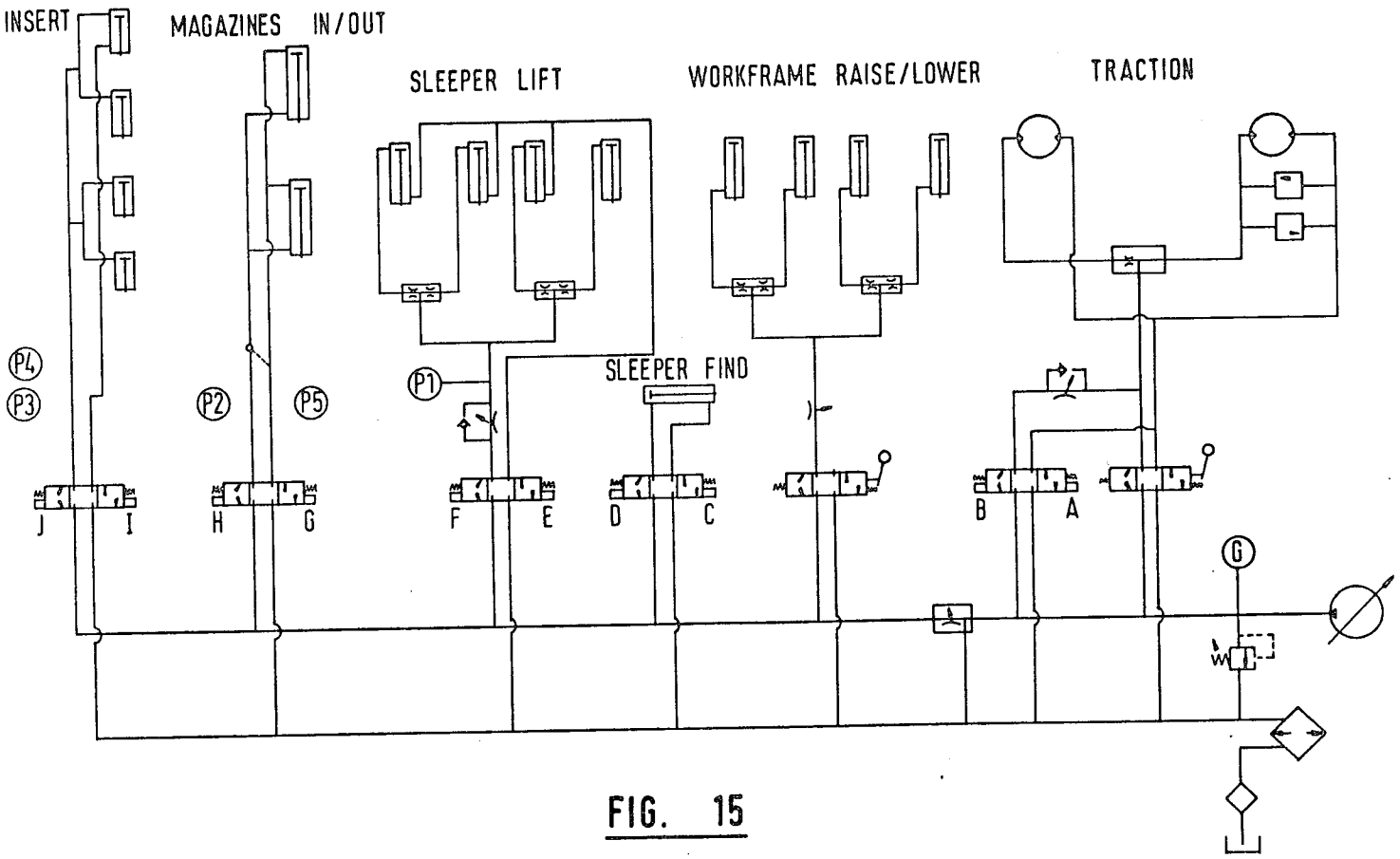
FIG. 15 is an hydraulic circuit diagram of the operating parts of the apparatus and the trolley on which the apparatus is mounted.

FIG. 15 shows a hydraulic circuit diagram which controls the operation of the various parts of the apparatus, and of the trolley which carries the apparatus.

The operating sequence of the trolley and apparatus is controlled by an electric circuit using electromechanical relays to operate hydraulic valve control solenoids in predetermined sequence. The relays are operated by signals from first of all the operator to start the sequence, second the sensor (which comprises an inductive proximity switch which senses the sleeper housing), and then through the rest of the sequence by pressure switches in the hydraulic circuit and microswitches attached to the installation mechanism.

The sleeper sensing device, or "sleeper finder" is an inductive proximity switch mounted on a mechanism to move it in and away from the rail, allowing the clips to be installed when it is in its retracted position.

The sensor transmits energy which is absorbed by the sleeper housing, triggering the proximity switch and thus sending a signal to a relay in the automatic sequence.

The sequence of operation of the circuit of FIG. 15 is as follows:

A, C, D, E, F, G, H, I, J, are solenoids, and P1 to P5 inc. are pressure switches.

Select Auto ON (1)
Press auto GO
Energise A & C
Machine moves forward and sleeper find lowers (2)
Sensor locates shoulder
De-energise A & C
Energise D & E
Retracts sleeper find and lifts sleeper operating P1

(3)
Signal from P1
De-energise D & E
Energise G
Magazines swing in operating P2

(4)
Signal from P2
De-energise G
Energise I
Insert clip part way operating P3

(5)
Signal from P3
Energise F
Sleeper lift retracts, operating micro switch to de-energise F,
allowing clip to go fully home operating P4

(6)
Signal from P4
De-energise I
Energise J & H
Insert levers and magazines retract operating P5 & microswitch (7)
Signal from P5 & microswitch
De-energise J & H
Energise A & C (8)
Repeat To stop auto-cycle at any time
Press auto STOP (1)
De-energise A
Energise D, F, H, J.

To isolate auto cycle switch to auto OFF
De-energise A, D, F, H, J.

I claim:

1. A rail clip fastening vehicle which is arranged to run on at least one rail of a railway track and to drive e-shaped rail clips into housings on either side of the rail in order to hold-down the rail, each clip having a first end which forms a centre leg of the clip to be received by a respective housing and a second end spaced from the first end and extending in an opposite direction relative thereto, and the vehicle comprising:

an upright slideway mounted on the vehicle and constructed to receive a stack of e-shaped rail clips, with their centre legs substantially horizontal, and having a clip-discharge outlet at its lower end;

a guiding part arranged in the slideway to project between the first and second ends of the clips of the stack and thereby guide the descent of the clips to the discharge outlet;

and a clip driver movable through the discharge outlet to drive the lowermost clip of the stack into one of said housings, the clip driver being shaped to engage with the second end and with a curved arched portion of the clip adjacent to the first end in order to drive the first end into the housing, and withdrawal of the clip driver permitting the next lowest clip of the stack to descend to the discharge outlet.

2. A vehicle according to claim 1, in which the slideway comprises a tubular chute of rectangular internal shape, as seen in cross-section, and said guiding part comprises a web which extends into the interior of the chute from one side of it.

3. A vehicle according to claim 2, including a stop fixed to the slideway and arranged to determine a rest position for the lowest clip of the stack.

4. A vehicle according to claim 1, in which the clip driver has one driving face which is engageable with said second end of each clip, and a further driving face which is curved for engagement with said curved arch portion of each clip.

5. A rail clip fastening vehicle which is arranged to run on at least one rail of a railway track and to drive e-shaped rail clips into housings on either side of the rail in order to hold-down the rails, each clip having a first end which forms a centre leg of the clip to be received by a respective housing and a second end spaced therefrom and extending in an opposite direction relative thereto, and the vehicle comprising:

a support member mounted on the vehicle and supporting first and second slideways, each constructed to receive a stack of the e-shaped clips, with their centre legs substantially horizontal, and each slideway including a guiding part which projects between the first and second ends of the clip in its stack of clips;

means for moving the lower end of the first slideway towards a first housing on one side of the rail and for moving the lower end of the second slideway towards an adjacent second housing on the opposite side of the rail;

means mounting said support member on the vehicle for movement relative to the vehicle in either direction longitudinally of the rail in order to compensate for any misalignment of a sleeper and its housings whereby, in the event of one slideway engaging its respective housing in advance of the engagement of the other slideway with its respective housing, the support member moves relative to the vehicle until both of the slideways engage their respective housings;

and means for displacing the lowest clip in each stack from a particular location at the bottom of the respective slideway so that its centre leg enters one of the housings.

6. A vehicle according to claim 5, including resilient means arranged to resist movement of the support member relative to the vehicle.

7. A vehicle according to claim 5, including a sleeper lifter device for raising a sleeper which is too low to a position suitable to receive the clip by engaging with a housing provided on the sleeper, the lifter device comprising an arm pivotally mounted on the apparatus and carrying a sleeper follower which is engageable with the upper surface of a sleeper on pivoting of the arm, and a locator pin receivable by the housing and operable to raise the housing and the sleeper to a predetermined height upon pivoting of the arm.

8. A vehicle having apparatus for driving railway rail-fastening clips into housings provided in a sleeper, one on each side of a rail, in order to hold-down the rail onto the sleeper, said vehicle being able to advance the apparatus from sleeper to sleeper along a track, and said apparatus comprising:

a support member mounted on the vehicle and supporting first and second slideways, each constructed to receive a stack of said clips;

means for moving the lower end of the first slideway towards a first housing on one side of the rail and for moving the lower end of the second slideway towards an adjacent second housing on the opposite side of the rail;

means for driving the lowest clip in each stack from a particular location at the bottom of the associated slideway, so as to move into rail-retaining engagement with a corresponding housing;

and a parallelogram linkage mounted on the vehicle and connected to the apparatus so as to enable the apparatus to carry out lateral movement relative to the vehicle.

9. A vehicle according to claim 8, including a track follower device coupled with the apparatus and engageable with an unfastened rail in order to guide the lateral adjustment of the apparatus relative to the vehicle.

10. A vehicle according to claim 9, in which the follower device comprises a pair of rollers which are rotatable about substantially vertical axes and which are arranged to embrace the upper end of the rail therebetween.

11. A vehicle according to claim 9, including a pair of follower devices arranged fore and aft of the apparatus with respect to the intended direction of travel along a rail.

12. A vehicle according to claim 9, in which the follower device comprises a pair of wheels rotatable about vertical axes and spaced apart to receive and to engage with opposite faces of a rail web.

13. A vehicle according to claims 8, in which the support member is tubular and is movble relative to the vehicle in a direction longitudinally of the rail against resilient opposition so that, in the event that one of the slideways comes into cooperation with a respective housing before the other slideway comes into cooperation with its respective housing, the support member yields by a sufficient amount to bring said other slideway into full cooperation with its housing.

14. A vehicle according to claim 13, including a pair of parallelogram linkages arranged one at each end of the tubular support member.

15. A vehicle according to claim 14, in which the support member comprises an upper support extending between the parallelogram linkages and a lower telescopic support suspended from the upper support.

16. A vehicle according to claim 8, including a sleeper sensing device mounted on the apparatus and arranged to control the movement of the vehicle from sleeper to sleeper along the track.

17. A vehicle according to claim 16, in which the vehicle is a self-propelled trolley and includes a control arrangement which automatically advances the trolley from one sleeper to the next when a rail fastening operation has been completed, and in which the sensing devices includes a sensor which is arranged to respond to the presence of metal on a sleeper in order to cause automatic stoppage of the trolley when it reaches the next sleeper.

18. A vehicle according to claim 17, in which the sensor is mounted on the apparatus for movement between a sensing mode in which it moves closely over the surface of a sleeper so as to detect the presence of a metallic housing, and an inoperative mode in which it is out of the way, and does not impede, the operation of the various devices for carrying out the rail fastening operation.

19. A vehicle according to claim 18, in which the sensor is pivotally mounted on the apparatus for movement about an axis extending generally horizontally and longitudinally of the trolley.

20. A vehicle according to claim 8, including a sleeper lifter device for raising a sleeper which is too low to a position suitable to receive a clip by engaging with a housing provided on the sleeper, the lifter device comprising an arm pivotally mounted on the apparatus and carrying a sleeper follower which is engageable with the upper surface of a sleeper upon pivoting of the arm, and a locator pin receivable by the housing and operable to raise the housing and the sleeper to a predetermined height upon pivoting of the arm.

21. A vehicle having apparatus for driving railway rail-fastening clips into housings provided on a sleeper, one on each side of a rail, in order to hold-down the rail onto the sleeper, the vehicle being operable to advance the apparatus from sleeper to sleeper along a track, and said apparatus comprising:

a support member arranged on the vehicle to support first and second slideways, each constructed to receive a stack of said clips;

means for moving the lower end of the first slideway towards a first housing on one side of the rail and for moving the lower end of the second slideway towards an adjacent second housing on the opposite side of the rail;

means for driving the lowest clip in each stack from a particular location at the bottom of the associated slideway, so as to move into rail-retaining engagement with the corresponding housing;

a sleeper sensing device mounted on the apparatus and arranged to respond to the presence of metal on each sleeper;

and a control arrangement coupled with the sleeper sensing device and arranged to supply a stopping signal to a control device which controls the motion of the vehicle.

22. A vehicle having apparatus for driving railway rail-fastening clips into housings on a sleeper on opposite sides of a railway rail in order to hold-down the rail, said vehicle being operable to advance the apparatus from sleeper to sleeper along a track, and said apparatus comprising:

a support member arranged on the vehicle to support first and second slideways, each constructed to receive a stack of rail-fastening clips, and having a lower clip-discharge outlet;

a respective clip driver associated with each slideway and operable to displace the lowermost clip in the slideway through the discharge outlet and into engagement with one of the housings;

means for moving the lower end of the first slideway towards a first housing on one side of the rail and for moving the lower end of the second slideway towards an adjacent second housing on the opposite side of the rail;

means mounting said support member on the vehicle for movement relative to the vehicle in either direction longitudinally of the rail in order to compensate for any misalignment of a sleeper and its housings whereby, in the event of one slideway engaging its respective housing in advance of the engagement of the other slideway with its respective housing, the support member moves relative to the vehicle until both slideways fully engage with their respective housings;

a mounting arrangement connected to the apparatus and mounted on the vehicle so as to enable the apparatus to carry out lateral movement relative to the vehicle;

a sleeper sensing device mounted on the apparatus and arranged to respond to the presence of metal on each sleeper; and a control arrangement coupled with the sleeper sensing device and arranged to supply a stopping signal to a control device which controls the motion of the vehicle.

* * * * *